US005211590A

United States Patent [19]

Smith et al.

[11] Patent Number: 5,211,590

[45] Date of Patent: May 18, 1993

[54] REPAIRABLE ELECTRIC CABLE CONNECTOR WITH SNAP TOGETHER BACKSHELL

[75] Inventors: Kimberly P. Smith, Hamilton; William W. Stockton, Jr., Cincinnati, both of Ohio

[73] Assignee: General Electric Company, Cincinnati, Ohio

[21] Appl. No.: 805,134

[22] Filed: Dec. 11, 1991

[51] Int. Cl.[5] ..... H01R 13/42

[52] U.S. Cl. ..... 439/894; 439/906

[58] Field of Search ..... 439/904–906, 439/607, 894, 610

[56] References Cited

U.S. PATENT DOCUMENTS

| | | | |
|---|---|---|---|
| 3,078,436 | 2/1963 | Berry | 439/610 |
| 3,659,251 | 4/1972 | Fish | 339/143 R |
| 3,944,317 | 3/1976 | Oberdiear | 439/610 |
| 4,018,979 | 4/1977 | Young | 439/906 |
| 4,111,513 | 9/1978 | Thurston et al. | 439/610 |
| 4,243,290 | 1/1981 | Williams | 339/143 R |
| 4,382,653 | 5/1983 | Blanchard | 339/143 R |
| 4,422,710 | 12/1983 | Perona | 339/177 R |
| 4,531,805 | 1/1985 | Werth | 339/143 R |
| 4,583,809 | 4/1986 | Werth et al. | 339/143 R |
| 4,613,198 | 9/1986 | Selvin et al. | 439/906 |
| 4,671,598 | 6/1987 | Keehne | 439/610 |
| 4,804,338 | 2/1989 | Dibble et al. | 439/583 |
| 4,808,128 | 2/1989 | Werth | 439/610 |
| 4,830,628 | 5/1989 | Dyson et al. | 439/584 |
| 4,854,891 | 8/1989 | Kami et al. . | |
| 4,857,015 | 8/1989 | Michaels et al. . | |
| 4,921,441 | 5/1990 | Sauder . | |
| 4,921,449 | 5/1990 | Fish . | |
| 4,964,815 | 10/1990 | Kawai et al. | 439/906 |

FOREIGN PATENT DOCUMENTS

| | | | |
|---|---|---|---|
| 40941 | 12/1981 | European Pat. Off. | 439/610 |
| 2611316 | 8/1988 | France | 439/320 |
| 62-225970 | 3/1989 | Japan . | |

OTHER PUBLICATIONS

CFM Component Maintenance Manual (Jan. 1, 1988) for Electrical Harness J12 (Part Number 320–198–50-1–0) pp. 605, 612, 621, 625, 627, 628, 630, 646, 1002 and 1003.

*Primary Examiner*—Paula A. Bradley

*Attorney, Agent, or Firm*—Bernard E. Shay; Jerome C. Squillaro

[57] ABSTRACT

A repairable cable termination comprising a cable transition adapted to receive an electrical cable. The cable transition including a first tubular region adapted to receive an outer shield of the cable, an antirotation sprocket and a second tubular region adapted to receive the inner shields of the wires in the cable. The cable termination further comprising top and bottom shells adapted to fit over the cable transition piece and including teeth adapted to engage the antirotation sprocket and prevent the cable transition from rotating relative to the top and bottom shells. The top and bottom shells being further adapted to fit over one end of the electrical connector and engage an antirotation sprocket attached thereto. The bottom shell including slots adapted to receive the ends of a C-clip which may be snapped over the top shell to hold the top and bottom shells together.

1 Claim, 2 Drawing Sheets

REPAIRABLE ELECTRIC CABLE CONNECTOR WITH SNAP TOGETHER BACKSHELL

The U.S. Government has rights in this invention pursuant to contract no. F33657-83-C-0281 awarded by the U.S. Air Force.

The following commonly assigned applications are directed to related subject matter and are being concurrently filed with the present application, the disclosures of which are hereby incorporated herein by reference.

U.S. patent application Ser. No. 07/805,135, filed on Dec. 11, 1991 now Pat. No. 5,183,417.

U.S. patent a pplication Ser. No. 07/805,136, filed on Dec. 11, 1991.

The present invention relates in general to electric cable connectors and, more particularly, to a repairable electric cable connector including a snap together backshell.

BACKGROUND OF THE INVENTION

Electric cables for modern aircraft engines normally include a number of individually shielded wires or wire pairs surrounded by a shielded jacket cable or a conduit which is itself surrounded by a shield. Since most discontinuities in such cables occur at the cable connectors, it would be advantageous to design a cable termination wherein the individual wires would be easily accessible and repairable. It would further be advantageous if the cable termination or connector were designed such that repairs to individual wires did not destroy the EMI shielding or the environmental seal of the connector. Finally, it would be advantageous to eliminate the potting material normally used to protect individual wires between the cable end and the connector.

SUMMARY OF THE INVENTION

A repairable cable termination comprising a cable transition adapted to receive an electrical cable. The cable transition including a first tubular region adapted to receive an outer shield of the cable, an antirotation sprocket and a second tubular region adapted to receive the inner shields of the wires in the cable. The cable termination further comprising top and bottom shells adapted to fit over the cable transition piece and including teeth adapted to engage the antirotation sprocket and prevent the cable transition from rotating relative to the top and bottom shells. The top and bottom shells being further adapted to fit over one end of the electrical connector and engage an antirotation sprocket attached thereto The bottom shell including slots adapted to receive the ends of a c-clip which may be snapped over the top shell to hold the top and bottom shells together.

BRIEF DESCRIPTION OF THE DRAWINGS

The novel features of the invention are set forth with particularity in the appended claims. The invention itself, however, both as to organization and method of operation, together with further objects and advantages thereof, may best be understood by reference to the following description taken in conjunction with the accompanying drawings in which:

DETAILED DESCRIPTION OF THE INVENTION

Figure 1:
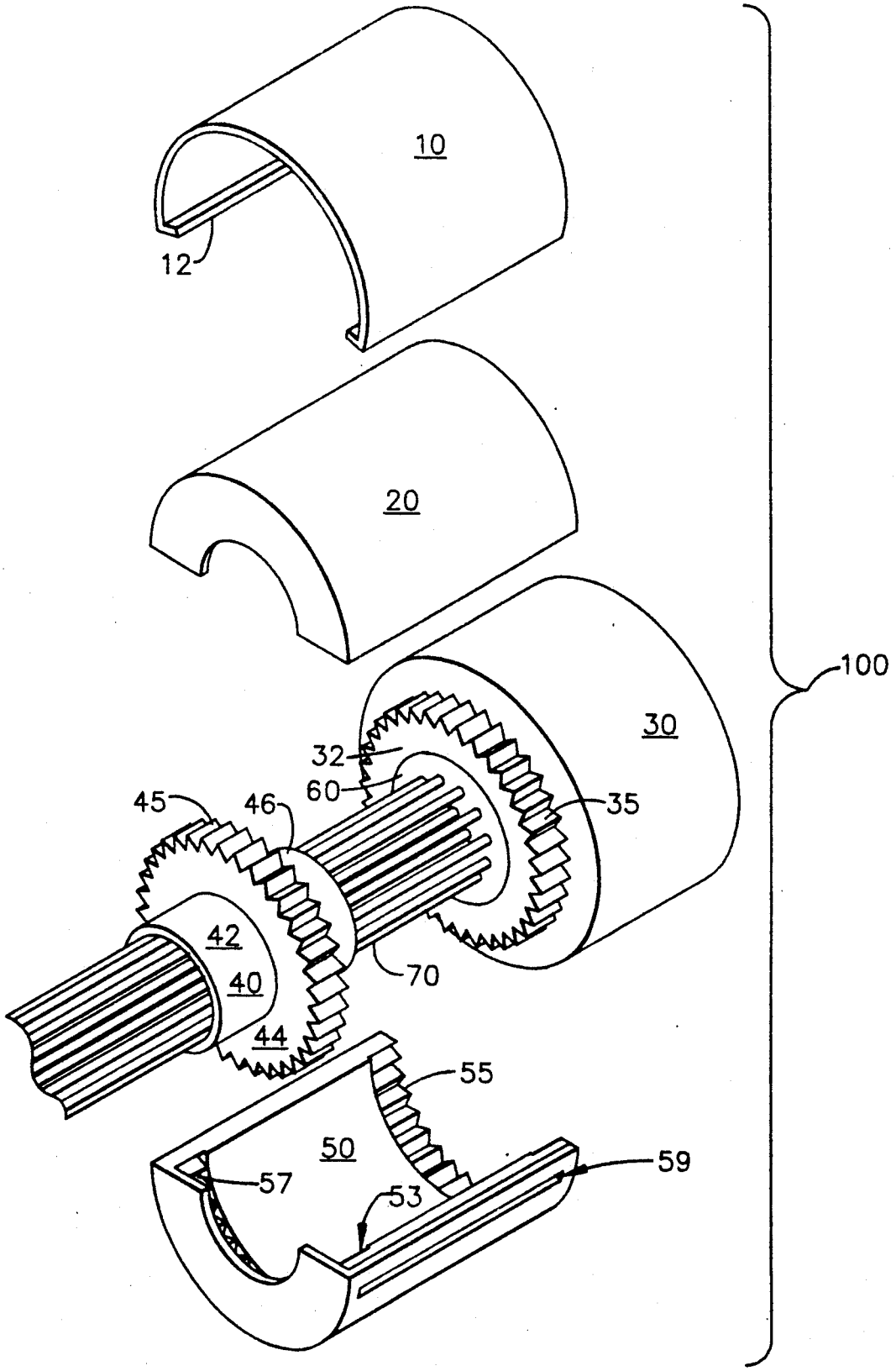
FIG. 1 is an exploded view of a cable termination according to the present invention.

FIG. 1 is an exploded view of a cable termination 100 according to the present invention. In FIG. 1, a cable transition piece 40 is adapted to receive a cable. The cable may comprise, for example, an outer electromagnetic shield surrounding a number of individual, twisted pair, coaxial or other signal wires. The signal wires may include electromagnetic shields which may be referred to as "inner shields".

Cable transition piece 40 comprises first tubular portion 42, raised central portion 44 and second tubular portion 46. First tubular portion 42 is adapted to receive the outer shield (not shown) of the cable. The outer shield may be attached to first tubular portion 42 by, for example, a band clamp or other suitable device. Raised portion 44 includes antirotation teeth 45 which are designed to prevent cable transition piece 40 from rotating relative to the other pieces of termination 100. Second tubular portion 46 is adapted to receive the inner shields of the cable, which may be attached thereto by, for example, a band clamps or other suitable device.

Wires 70 from the cable pass through transition piece 40 to wire guide 60 which is mounted in connector 30 such that wire guide 60 does not rotate with respect to connector 30. Sprocket 32 surrounds wire guide 60 and includes antirotation teeth 35 which are designed to prevent sprocket 32 and wireguide 60 from rotating with respect to termination 100.

Top shell 20 is adapted to fit over cable transition piece 40 and includes internal antirotation teeth (not shown) which mate with antirotation teeth 35 and 45. Bottom shell 50 is adapted to fit over cable transition piece 40 and includes internal antirotation teeth 57 and 55 which mate with antirotation teeth 35 and 45, respectively, to prevent relative rotation of cable transition piece 40, connector 30, top shell 20 and bottom shell 50.

Bottom shell 50 includes slots 59 in the side thereof adapted to receive edges 12 of C clip 10. Slots 59 would not normally extend through the thickness of bottom shell 50 since it is desirable to maintain the integrity of the EMI shielding provided by the top and bottom shells. C clip 10 is a flexible piece which includes edges 12 adapted to fit in slots 59. Therefore, when top shell 20 and bottom shell 50 are fitted together over cable transition 40, wires 70 and teeth 35, C clamp 10 is placed over bottom shell 50 and edges 12 engage slots 59 to hold top shell 20 and bottom shell 50 in place.

Figure 2:
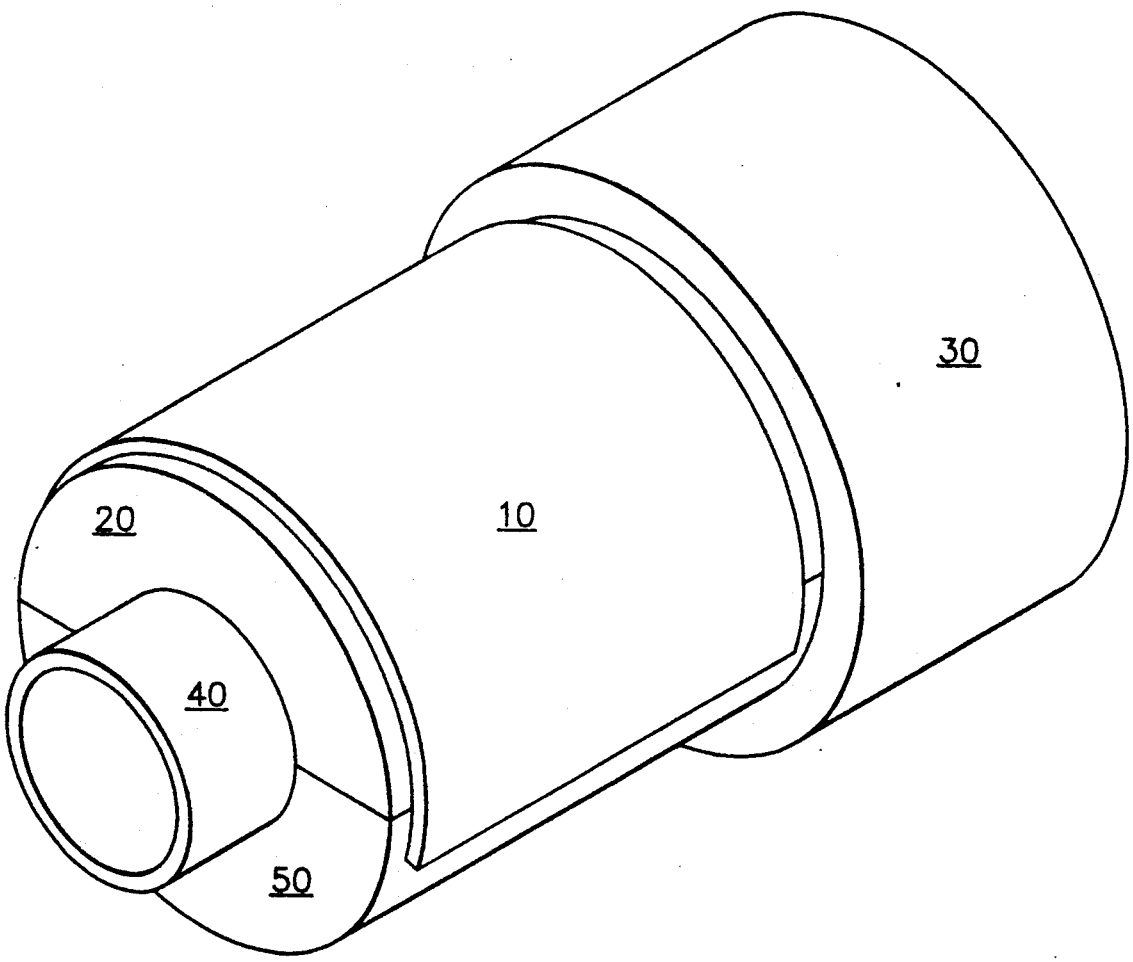
FIG. 2 is a view of an assembled cable termination according to the present invention

FIG. 2 illustrates a complete assembled connector 100 according to the present invention. In FIG. 2, top shell 20 is joined with bottom shell 50. Transition piece 40 is mounted between top shell 20 and bottom shell 50. C clamp 10 engages bottom shell 50 and holds the top and bottom shells in place.

It will be apparent to those of skill in the art that the present invention may be improved by, for example, providing fluid resistant seals at all of the mating surfaces. The fluid resistant seals would prevent water, fuel or other contaminants from reaching wires 70.

While preferred embodiments of the present invention have been shown and described herein, it will be obvious to those skilled in the art that such embodiments are provided by way of example only. Numerous variations, changes, and substitutions will now occur to those skilled in the art without departing from the invention. Accordingly, it is intended that the invention be limited only by the spirit and scope of the appended claims.

What we claim is:

1. A cable termination comprising:

first and second semicircular shell pieces wherein said first and second shell pieces include antirotation teeth;

a cable transition piece including a central sprocket;

a connector including a wire guide mounted within a sprocket wherein said central sprocket and said connector sprocket include antirotation teeth adapted to mate with said antirotation teeth in said first and second shell pieces; and a flexible chip adapted to join said first and second shell pieces together over said cable termination piece and said connector sprocket wherein said flexible clip includes ridges at first and second edges thereof and said second shell piece includes slots therein adapted to receive said ridges.

* * * * *